United States Patent [19]

Pujari

[11] Patent Number: 4,556,090

[45] Date of Patent: Dec. 3, 1985

[54] VACUUM FLUIDIZED POWDER FEED APPARATUS

[75] Inventor: Vimal K. Pujari, Columbia, Md.

[73] Assignee: Allied Corporation, Morristown, N.J.

[21] Appl. No.: 589,905

[22] Filed: Mar. 14, 1984

[51] Int. Cl.[4] ..... B65B 1/04

[52] U.S. Cl. ..... 141/59; 141/67; 141/72; 141/250

[58] Field of Search ..... 141/1-12, 141/59, 71-81, 250-284, 67, 37-58, 60-66, 70

[56] References Cited

U.S. PATENT DOCUMENTS

| | | | |
|---|---|---|---|
| 3,336,955 | 8/1967 | Feldman et al. | 141/72 |
| 3,338,999 | 8/1967 | Knapp | 264/113 |
| 3,353,572 | 11/1967 | Anderson et al. | 141/72 |
| 3,856,441 | 1/1974 | Suzukawa et al. | 425/7 |
| 3,963,459 | 6/1976 | Vinard | 51/298 |
| 4,278,113 | 7/1981 | Persson | 141/1 |

*Primary Examiner*—Houston S. Bell, Jr.
*Attorney, Agent, or Firm*—James R. Ignatowski; Russel C. Wells

[57] ABSTRACT

A vacuum fluidized powder feed apparatus for filling an evacuated mold. The fluidized powder feed apparatus has a feed cup defining a cylindrical cavity for holding a quantity of powdered material and a powder exit aperture provided through the bottom of the feed cup mating with the fill aperture of the mold. A porous annulus disposed at the bottom of the cylindrical cavity has a conically shaped internal surface sloping toward and mating with the exit aperture of the feed cup. Vent holes provided in the side walls of the feed cup cause a fluid flow through the porous annulus into the interior of the cylindrical cavity which is connected to the evacuated mold cavity through the exit aperture. A pneumatic piston received in the cylindrical cavity engages the top of the powdered material and produces a force cavity urging the powdered material towards the exit aperture. The fluid flow through the porous annulus fluidizes the powdered material enhancing its flowability through the exit aperture into the evacuated mold cavity. The powder feed apparatus and powder mold may be vibrated to further enhance the powdered material into the mold cavity and the distribution of the powdered material in the mold cavity.

15 Claims, 7 Drawing Figures

Fig-2
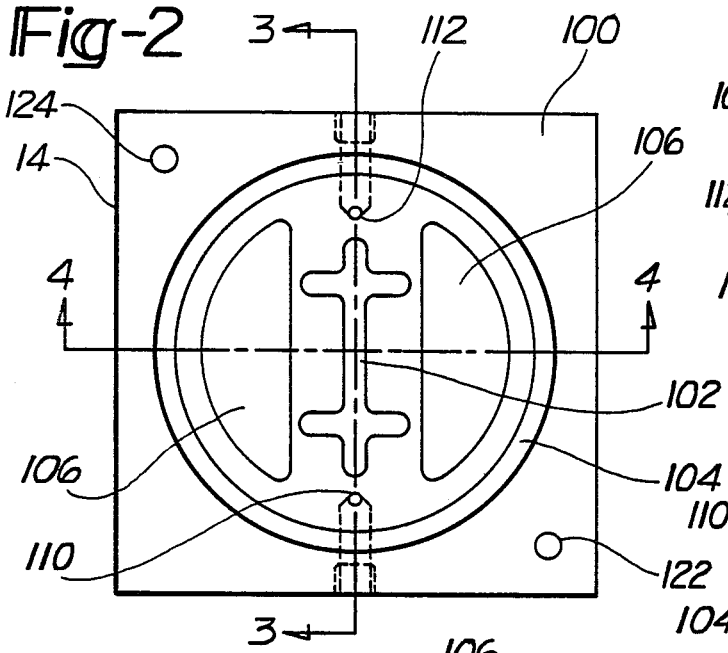
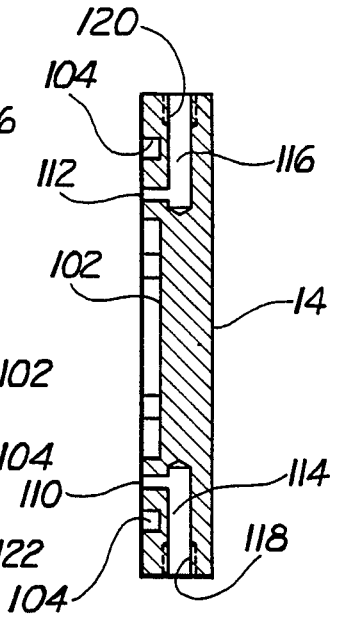
Fig-3
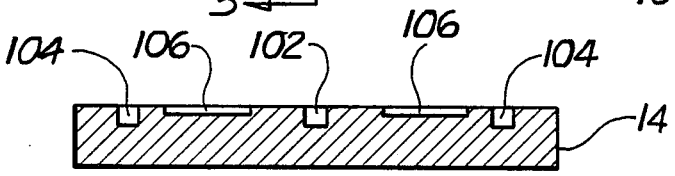
Fig-4
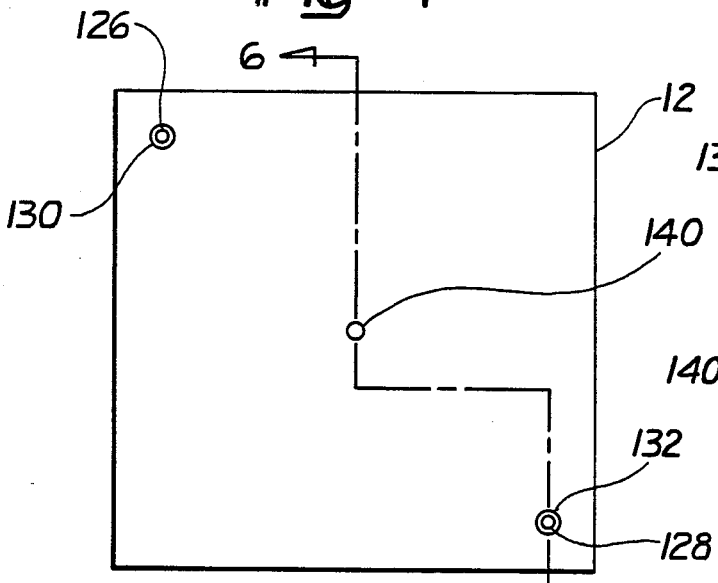
Fig-5
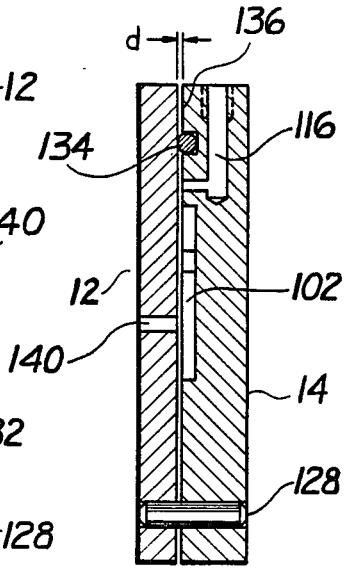
Fig-6

VACUUM FLUIDIZED POWDER FEED APPARATUS

BACKGROUND OF THE INVENTION

1. Cross Reference

This application is related to copending application Ser. No. 589906 filed on Mar. 14, 1984 concurrently herewith which also describes the dilatant mold apparatus and fluidized powder feed disclosed herein.

2. Field of the Invention

The invention is related to the field of powder forming and in particular to an apparatus for feeding powdered material to a powder forming mold.

3. Prior Art

In conventional powder metallurgical processes, powdered material is flowed into and compacted inside of the mold cavity using brute force through the application of external pressure. The feed apparatus and mold are usually vibrated to inhibit the powdered material from agglomorating and restricting the flow of the powdered material into the mold cavity. However, even with vibration the powdered material still has a tendency to agglomerate and bridge resulting in incomplete filling of the mold cavity, even when extreme external pressure is applied.

The invention is an improved powder feed apparatus in which the powdered material is fluidized to enhance its flow characteristics and alleviate the problems of the prior art powder feed mechanisms.

SUMMARY OF THE INVENTION

The invention is an improved powder feed apparatus of the type having a feed cup defining an internal cylindrical cavity for holding a quantity of powdered material, an exit aperture provided through the bottom of the feed cup connecting the cylindrical cavity with an evacuated chamber of a utilization device to be filled with the powdered material, and means received in the cylindrical cavity for producing a force urging the powdered material towards the exit aperture. The improvement characterized by a porous annulus disposed in the bottom of the feed cup having an external diameter mating with the internal surface of the cylindrical cavity and an internal conical surface sloping towards and terminating in an aperture coincident with said exit aperture and a vent aperture provided through the sidewall of said feed cup intercepting the peripheral edge of said porous annulus permitting a gaseous fluid flow into said cylindrical cavity through said porous annular. The gaseous fluid flow through said porous annulus fluidizing the powdered material and a producing a fluidized powder flow directed through the exit aperture into the evacuated chamber of the utilization device.

In the preferred embodiment, the powder feed apparatus is used in conjunction with powder mold which includes means for vibrating the mold to enhance the transport and distribution of the powdered material in the mold cavity.

The advantage of the improved powder feed apparatus is that the fluidizing of the powdered material adjacent to and through the exit aperture prevents the powdered material from agglomerating in this region assuring complete filling of the mold cavity. Another advantage of the improved powder feed mechanism is the use of the reduced pressure in the evacuated mold cavity to draw the fluidized powdered material into the mold cavity eliminating the need for an external source of pressurized fluid for fluidizing the powdered material. These and other advantages of the improved powder feed apparatus will become apparent from a reading of the specification in conjunction with the drawings.

BRIEF DESCRIPTION OF THE DRAWINGS

FIG. 2 is a top view of the bottom half of the dilatent mold.

FIG. 3 is a cross-sectional side view of the bottom half of the mold.

FIG. 4 is a cross-sectional side view of the bottom half of the mold rotated 90° with respect to FIG. 3.

FIG. 5 is a top view of the top half of the mold.

FIG. 6 is a cross-sectional side view of the mold assembly before compression.

DETAILED DESCRIPTION OF THE INVENTION

Figure 1:
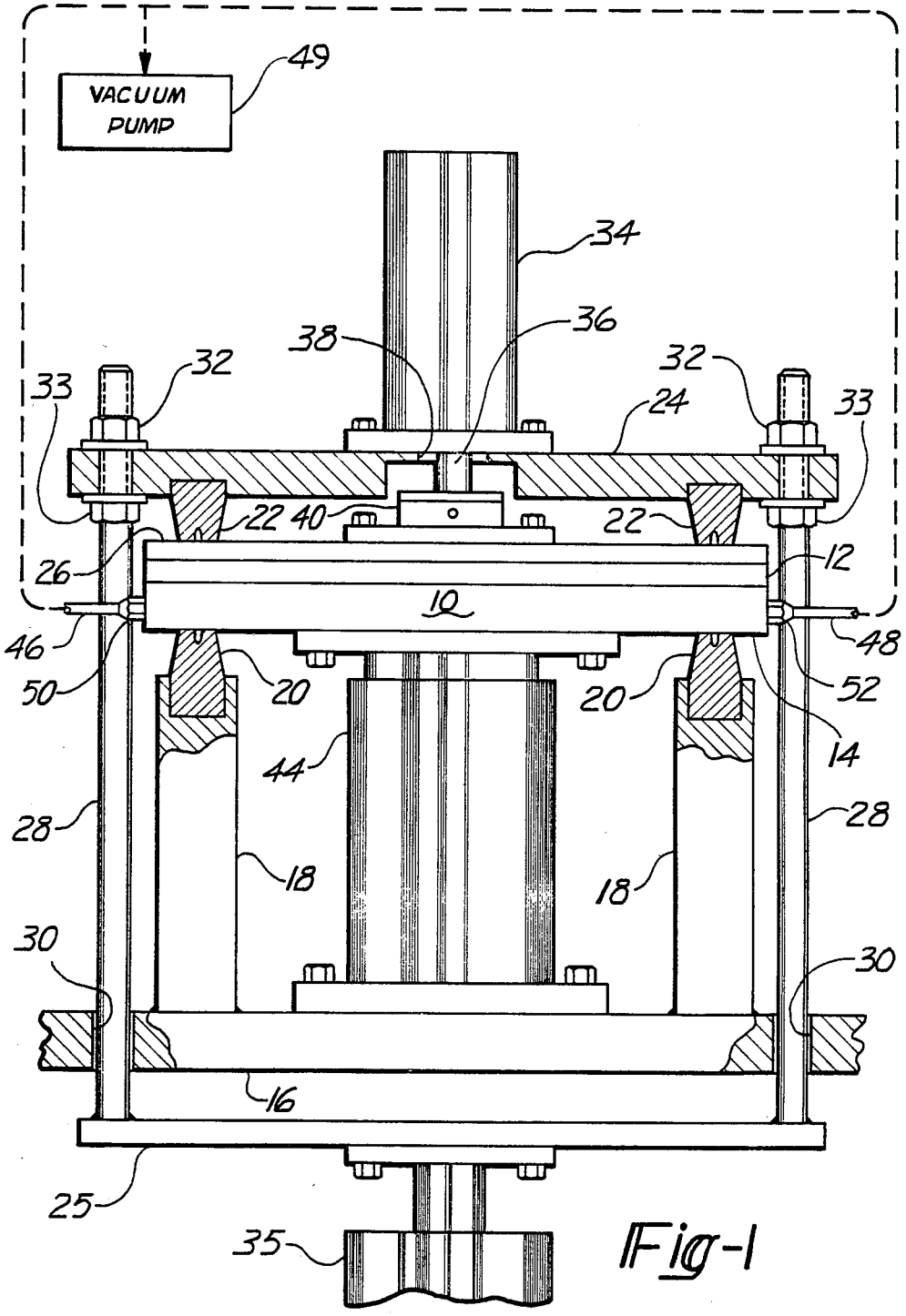
FIG. 1 is a frontal view of the powder molding apparatus.

The apparatus for vibratory powder forming using a dilatant mold is illustrated in FIG. 1. The dilatant mold 10 comprising a top half 12 and a bottom half 14 is mounted for vibration from a base plate 16. Attached to the base plate 16 are a plurality of upright pedestals 18, each having a vibration isolator 20 attached to the end opposite the base plate. The vibration isolators 20 may be trunkated rubber members captivated in a recess at the ends of the pedestals as shown or may be any other type of commercially available vibration isolator or shock mount known in the art. The other end of the vibration isolators 20 engage and support the bottom half 14 of the dilatant mold 10 substantially parallel to the base plate 16.

A second plurality of vibration isolators 22 are disposed between a top platten 24 and a feed support plate 26 fixedly attached to the top half 12 of the dilatant mold 10. The top platten 24 is held in position above the dilatant mold 10 by a plurality of stress rods 28. One end of each stresss rod 28 is attached to top platten 24 between opposing nuts 32 and 33 as shown while the opposite ends are attached to a bottom platten 25 through mating apertures 30 in the base plate 16. A compressive force urging the top half 12 of the dilatant mold 10 against the bottom half 14 is achieved by a pneumatic cylinder 35 attached to bottom platten 25 below the base plate 16.

A pneumatic cylinder 34 attached to the top platten 24 has a piston 36 passing through an appropriate aperture 38 in the top platten 24 exerting a downward force on powdered material contained in a fluidized powder feed 40 attached to the top surface of the feed support plate 26.

A vibrator 44 is attached between the base plate 16 the lower surface of the bottom half 14 of dilatant mold 10. The vibrator 44 may comprise a single vibrator, as shown, vibrating the bottom half of dilatant mold in the vertical plane. Alternatively, more than one vibrator may be attached to the bottom half 12 of the dilatant mold simultaneously vibrating the bottom half 14 along different axes, such as two or three different mutually perpendicular axes. However it is understood the vibrational axes need not be mutually perpendicular and may be disposed at different angles relative to each other.

A pair of vacuum feed lines 46 and 48 are connected to the bottom half of mold 10 by a pair of vacuum connectors 50 and 52. The vacuum lines 46 and 48 interconnect the interior of mold 10 with a vacuum pump 49 through a pair of vacuum ports 110 and 112 in the bottom half of mold 10 as shall be explained with reference to FIGS. 2 and 3 hereinafter.

The details of the dilatant mold shall be discussed relative to FIGS. 2 through 5. Referring first to FIGS. 2 through 4, there is shown a plan view and two mutually perpendicular cross-sectional side views of the bottom half 14 of the dilatant mold. The bottom half 14 of the mold has a generally rectangular shape with a flat interface surface 100 and a centrally disposed mold cavity 102 corresponding to the shape of the part to be molded. The mold cavity 102 is circumscribed by a circular recess 104 adapted to receive a resilient circular sealing ring such as an "O" ring 134 shown in FIG. 6.

Shallow recesses, such as recess 106 are provided in the space between the mold cavity 102 and circular recess 104 to capture any powder that may spill out of the molded cavity 102 during dilatant vibration of the top and bottom halves of the mold. Vacuum ports, such as vacuum ports 110 and 112 are provided through the flat interface surface intermediate the mold cavity 102 and circular recess 104. The vacuum ports 110 and 112 are interconnected with vacuum channels 114 and 116 respectively. The vacuum channels 114 and 116 respectively exit the sides of the bottom half 14 and have threaded portions 118 and 120 respectively for receiving vacuum line connectors such as vacuum line connectors 50 and 52 shown on FIG. 1. Connectors 50 and 52 may include filters as is known in the art, to prevent powdered material from being sucked into the vacuum pump 49. A pair of dowel pin holes 122 and 124 are provided through the bottom half 14 adjacent to opposite corners as shown for receiving dowel pins 126 and 128 as shown in FIGS. 5 and 6.

Referring now tq FIGS. 5 and 6 there is shown a plan view and cross-sectional side view of the dilatant mold 10 and the details of the top half 12. The top half 12 has a generally rectangular shape with a flat interface surface 136 mating with interface surface 100 of the bottom half 14 and at least one centrally disposed fill aperture 140 through which the mold cavity 102 is filled with powder. The top half 12 also has a pair of dowel pin apertures 130 and 132 adapted to receive dowel pins 126 and 128 with a slip fit permitting the top half 12 of the mold to move vertically with respect to the bottom half 14 during vibration while maintaining registration between the fill aperture 140 with the mold cavity 102. A resilient circular seal, such as "O" ring 134 is disposed in circular recess 104 and forms a vacuum seal about the mold cavity 102 and vacuum ports 110 and 112. The cross-sectional diameter of the "O" ring is selected to be larger than the depth of circular recess 104 so that in an uncompressed state, as shown in FIG. 6, the top and bottom halves of the mold are separated by a small distance "d". When assembled on the pedestal, the "O" ring 134 is compressed by activating pneumatic cylinder to lower top platten 24 to form a good vacuum seal when the interface surfaces 100 and 136 are abutting or in close proximity to each other. This permits the top and bottom halves 12 and 14 to separate a small distance during the vibration of the mold 10 without losing the vacuum in the mold cavity 102.

Figure 7:
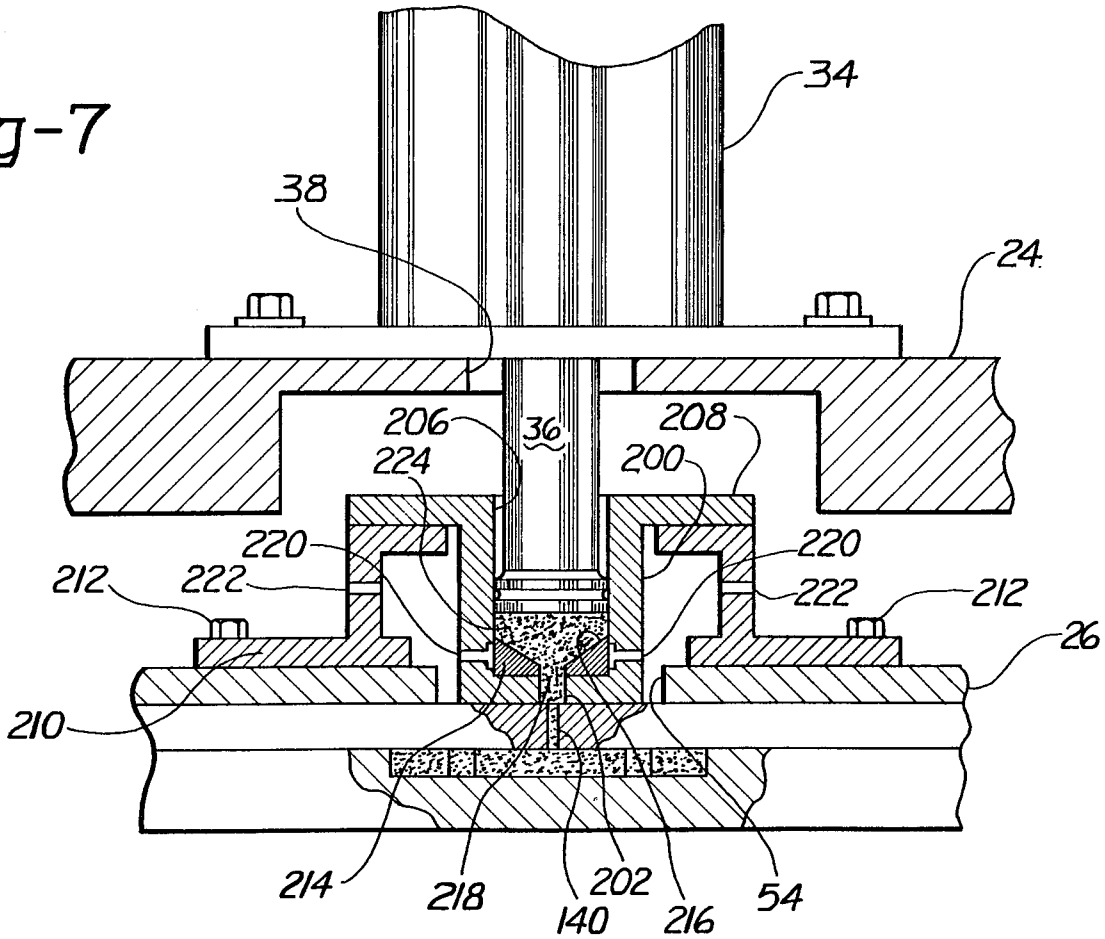
FIG. 7 is a cross section of the fluidized powder feed.

The details of the fluidized powder feed 40 are shown in FIG. 7. The top plate 26 has a clearance aperture 54 circumscribing the fill aperture 140. A cylindrical feed cup 200, having an axially exit port 202 provided in the bottom thereof, is disposed in said clearance aperture 54 with the exit port 202 concentric with the fill aperture 140 formed through the top half 12 of the mold 10. The feed cup 200 has an internal bore 206 receiving the piston 36 of the pnemuatic cylinder 34 with a sliding fit. A stabilizer flange 208 extends radially from the top of the feed cup 200 and abuts the top surface of a support collar 210 fixedly attached to the top plate using fasteners such as screws 212.

A porous annulus 214 having a mesh size between 3 to 10 microns is disposed at the bottom of feed cup 200. The porous annulus 214 has an internal conical surface 216 sloping downwardly from its periphery towards a central aperture 218 concentric with the exit aperture 202 of the feed cup. A plurality of vent apertures 220 are provided through the walls of the feed cup 200 adjacent to the porous annulus 214. The vent apertures 220 provide for an air flow through the porous annulus 214 into the mold cavity 102 when the pressure in the mold cavity 102 is reduced by the vacuum pump. In a like manner the support collar 210 has one or more vent apertures 222 providing for a free atmospheric pressure air flow into the space between the feed cup 200 and the support collar.

The resilience of pneumatic piston 36 permit limited vertical movement of the mold 10 during vibration while maintaining the physical contact between the bottom of the feed cup 200 with the top surface of mold 10. The piston 36 restrains lateral movement of the feed cup 200. Therefore, lateral movement of the mold during vibration will result in the bottom of the feed cup sliding laterally across the top surface of the mold 10.

Alternatively, a pressurized gas or air source may be connected directly to the vent apertures 220 to increase the gas flow through the porous annulus 214. To insure powder feed during vibration, the diameter of the exit port 202 of the feed cup 200 is larger than the diameter of fill aperture 140 permitting limited lateral movement between the feed cup 200 and the mold 10. The stabilizer flange 208, engaging the top surface of the support collar 210 maintains the feed cup 200 in a vertical position preventing the feed cup from cocking and binding the piston in internal bore 206.

The operation of the dilatant mold is as follows: The feed cup 200 is loaded with a quantity of powdered material 224 in excess of the quantity required to fill the mold cavity 102 in the dilatant mold 10. The pneumatic cylinder 34 is then activated to insert the piston 36 into the feed cup producing a predetermined force on the top surface of the powdered material urging the powdered materials towards the mold 10. The vibrator 44 is then activated to vibrate the dilatant mold and a vacuum from vacuum pump 49 is then applied to the vacuum ports 118 and 120 via vacuum lines 46 and 48 creating a reduced pressure in dilatant mold 10 inside the "O" ring seal 134. As the dilatant mold is vibrated, the powdered material in the feed cup 200 is urged to flow through the exit aperture 218 of the feed cup 200 and into the mold cavity 102 through feed aperture 140. The reduced pressure in the mold cavity 102 causes an air flow through the apertures 220 in the feed cup and porous annulus 214 fluidizing the powdered material adjacent to the conical surface 216 of the porous annulus 214 towards and through the exit and feed apertures 218 and 140 respectively into mold cavity 102. The fluidized flow in combination with the vibration of the dilatant mold 10 facilitates the filling of the mold cavity 102 and reduces the probability of the powdered material caking up or conglomerating at the exit aperture of the feed cup 200 which would otherwise inhibit the powder from flowing into the mold cavity 102. One advantage of the fluidized feed 40 is that the powdered material is fluidized adjacent to the exit aperture of the feed cup 200 enhancing its flow characteristics. Another advantage is that the fluidizing air flow is in a direction towards the mold cavity assisting the force of the pneumatic cylinder's piston 36 in transporting the powdered material.

During the vibration of the dilatant mold 10 inertial forces overcome the resilient forces provided by the vibration isolators holding the top and bottom halves of the dilatant mold together permitting the two halves of the dilatant mold to periodically separate a small distance causing a dilation of the mold cavity 102. This dilation of the mold cavity 102 causes the powder bed formed in mold cavity to shear and assists in distributing the powdered material uniformly throughout the mold cavity 102. The dilatant action of the two halves of the dilatant mold 10 also results in a semicompacted state of the powder material in the mold cavity. The ultimate packing of the powder as it flows inside the mold is accomplished by vibrating the mold at a predetermined frequency and acceleration. The use of multimodal powder mixtures in combination with the dilatant mold apparatus further enhances the packing density of the article being molded.

The air flow through the mold 10 from the fluidized feed 40 to the vacuum ports 110 and 112 sweeps the powdered material from between the interface surfaces 100 and 136 inside the resilient seal 134 permitting the interface surfaces to come into intimate contact with each other. The powder material swept from between the interface surfaces 100 and 136 is collected in the shallow recesses 106. Alternatively, the "O" ring surrounding the mold cavity 102 may be omitted. In this case the resiliency, and hence the dilation between the two halves of the mold 10, is provided by the vibration isolators 20 and 22. Without the "O" ring, the air flow at the parting line of the two halves of mold 10 is towards the evacuated mold cavity 102. This forms an air screen around the mold cavity 102 preventing powder leakage into the parting line.

It is intended that the invention not be limited to the specific configurations of the pedestal and dilatant mold shown in the drawings and discussed in the Specification. It is recognized that those skilled in the art may make changes to the physical configurations of these components without departing from the spirit of the invention as set forth in the appended claims.

I claim:

1. An improved powder feed apparatus of the type having a feed cup with an internal cylindrical cavity for holding a quantity of powdered material, an exit aperture provided through the bottom of said feed cup connecting the cylindrical cavity with an evacuated chamber of a utilization device to be filled with the powdered material and means received in said cylindrical cavity for producing a force urging said powdered material towards said exit aperture, the improvement characterized by:

a porous annulus disposed in the bottom of said feed cup having an external diameter mating with the internal surface of the feed cup's cylindrical cavity and an internal conical surface having a major aperture at the top of said porous annulus and a minor aperture at the bottom of the porous annulus concentric with the exit aperture of said feed cup; and at least one vent aperture provided through the sidewall of said feed cup adjacent to said porous annulus permitting a gaseous fluid flow into the cylindrical cavity through said porous annulus.

2. The powdered feed apparatus of claim 1 wherein the diameter of said major aperture of said conical surface is equal to said external diameter.

3. The powder feed apparatus of claim 1 wherein the means for producing a force is a pneumatic cylinder having a piston received in the feed cup's cylindrical cavity.

4. The powder feed apparatus of claim 1 further including a support collar attached to the utilization device, and wherein said feed cup has a radical flange engaging the top surface of said support collar.

5. The powder feed apparatus of claim 1 wherein the utilization device is a powder mold and the evacuated chamber is a mold cavity having a shape corresponding to the part to be molded.

6. The powder feed apparatus of claim 5 having means for vibrating said mold and said feed cup.

7. A fluidized powder feed apparatus for feeding powdered material into an evacuated chamber of a utilization device comprising:

a feed cup for receiving the powdered material having a bottom, and a cylindrical side wall defining an internal cylindrical cavity and an exit aperture through said bottom connecting said cylindrical cavity to the evacuated chamber of the utilization device;

a porous annulus disposed in the bottom of said cylindrical cavity, said porous annulus having an external diameter mating with the internal surface of said cylindrical cavity and a conical internal surface having a major aperture at the top of said porous annulus and a minor aperture at the bottom of said porous annulus concentric with said exit aperture of said feed cup;

at least one vent aperture provided through said at least one sidewall adjacent to said porous annulus permitting a gaseous fluid flow into said cylindrical cavity; and means received in said cylindrical cavity for producing a force urging said powdered material towards said exit aperture.

8. The apparatus of claim 7 wherein said major aperture of said conical surface has a diameter equal the external diameter of said porous annulus.

9. The apparatus of claim 8 wherein said means for producing a force is a pneumatic cylinder having a piston slidably received in said cylindrical cavity.

10. The apparatus of claim 7 having a support collar attached to the utilization device, said feed cup has a radial flange slidably engaging the top surface of said support collar.

11. The apparatus of claim 10 wherein said utilization device is a powder mold and said evacuated chamber is a mold cavity having a shape corresponding to the part to be molded.

12. The apparatus of claim 11 having means for vibrating said utilization device and said feed cup.

13. The apparatus of claim 12 having means for applying a pressurized gas to said at least one vent aperture.

14. A powder feed apparatus for filling the mold cavity of a powder mold having a fill aperture, means for vibrating the powder mold and means for evacuating the mold cavity, the powder feed apparatus comprising:

a feed cup having an enclosed bottom, a side wall circumscribing a cylindrical cavity adapted to receive a quantity of powdered material, an exit aperture provided through said enclosed bottom, at least one vent aperture provided through said sidewall proximate said enclosed bottom, and a flange extending radially from said sidewall;

a collar attached to said powder mold having an annular bearing surface slidably engaging said flange and supporting said feed cup with said enclosed bottom engaging the top surface of the powder mold and with said exit aperture concentric with said fill aperture;

a porous annulus disposed in the bottom of said cylindrical cavity and covering said at least one vent aperture, said porous annulus having an external diameter mating with the inner surface of said cylindrical cavity and a conical inner surface sloping downwardly and terminating an aperture concentric with said exit aperture;

a pneumatic cylinder means disposed above said feed cup having a piston slidably received in said cylindrical cavity and producing a force urging the powdered material in said cylindrical cavity towards said exit aperture.

15. The powder feed apparatus of claim 14 including means for applying a pressurized gas to said at least one vent aperture.

* * * * *